United States Patent [19]

Lee et al.

[11] Patent Number: 4,975,098

[45] Date of Patent: Dec. 4, 1990

[54] LOW PRESSURE DROP DETONATION ARRESTOR FOR PIPELINES

[76] Inventors: John H. S. Lee, 315 Querbes St., Outremont, Quebec, Canada, H2V 3W1; Roger A. Strehlow, 505 S. Pine, Champaign, Ill. 61820

[21] Appl. No.: 200,685

[22] Filed: May 31, 1988

[51] Int. Cl.[5] ..... F17D 3/00

[52] U.S. Cl. ..... 48/192; 431/346

[58] Field of Search ..... 48/192; 431/346; 110/119; 60/39.11; 220/88 R, 88 A; 55/DIG. 20

[56] References Cited

U.S. PATENT DOCUMENTS

| | | | |
|---|---|---|---|
| 3,243,272 | 3/1966 | Schmitz | 48/192 |
| 3,434,336 | 3/1969 | Harr | 220/88 R |
| 4,444,109 | 4/1984 | Gifford | 48/192 |

FOREIGN PATENT DOCUMENTS

| | | | |
|---|---|---|---|
| 1047091 | 11/1966 | United Kingdom | 431/346 |
| 1490993 | 11/1977 | United Kingdom | 431/346 |

OTHER PUBLICATIONS

Strehlow, "Combustion Fundamentals", Chapters 9 & 13, McGraw Hill Book Company, 1984.

Evans, M. W., et al., "Effects of Attenuating Materials on Detonation Induction Distances in Gasses", J. App. Phys., vol. 26, No. 9, pp. 1111–1113 (1955).

Dupre, G. et al., "Propagation of Detonation Waves in an Acoustic Absorbing-Walled Tube", Aug. 3–7, 1987.

*Primary Examiner*—Joye L. Woodard

*Attorney, Agent, or Firm*—Willian, Brinks, Olds, Hofer, Gilson & Lione

[57] ABSTRACT

A low pressure detonation arrestor arrangement for pipes or pipelines. The arrangement comprises an absorbent section interposed between two flame arrestors. The absorbent section may comprise an acoustically absorbent material or a wire mesh screen. The detonation arrestor arrangement is capable of arresting detonations propagating in either direction.

23 Claims, 2 Drawing Sheets

LOW PRESSURE DROP DETONATION ARRESTOR FOR PIPELINES

BACKGROUND OF THE INVENTION

The present invention relates to detonation arrestors for use in chemical processing and handling industries.

Chemical and pipeline industries pump flammable and detonatable gaseous mixtures between and within plants through pipes either intentionally, during normal operations or accidentally, during upset conditions. Under these circumstances accidental ignition of the combustible mixture can cause an explosion. An explosion may be contained by the piping and vessels of the system, but more often causes catastrophic rupture of portions of the system with attendant injury or loss of life, damage to the plant and costly business interruption.

Industry has attempted to control or prevent these ruptures by installing either vents or arrestors. Vents are designed to open rapidly when the local internal pressure rises above some preset value. These vents usually contain prescored sheet metal diaphragms. However, vents are ineffective when the burning rates are high, such as in the case of very fast deflagration or detonation propagation. While deflagrations are easy to quench with flame arrestors, detonations are extremely difficult to quench.

To arrest detonations, a series of detonation arrestors, or a combination of a single detonation arrestor with a pair of flame arrestors may be used. The arrestors are installed at strategic locations in the piping. Though the currently known arrestors are effective under certain conditions, they always create a high pressure drop in the line where they are installed. Thus, processing costs are increased because the cost of pumping the gases through the system are increased.

A swirl type detonation arrestor which does not create as high a pressure drop as the arrestors discussed above, has also been employed. This device, however, is effective only for one direction of detonation propagation.

An effective detonation arrestor system or arrangement which would not cause a high pressure drop in a line would be very desirable and widely accepted by those skilled in the art. If such an arrestor was effective in either direction of detonation propagation, it would be additionally welcomed by the industry.

It is therefore an object of the present invention to provide a low pressure drop detonation arrestor for use in chemical processing and handling systems. A further object is to provide a detonation arrestor which will cause a detonation to fail regardless of the direction of detonation propagation. A still further object of the present invention is to provide a detonation arrestor arrangement which, after causing a detonation to fail, will also extinguish the resulting flame, thus preventing any flame that is present to be accelerated to detonation.

Other objects of the present invention will be apparent to those skilled in the art in view of the following description and are therefore also contemplated. Objectives, however, are not to be considered a limitation of the present invention, the scope of which is defined by the appended claims.

SUMMARY OF THE INVENTION

In accordance with the present invention, there is provided an arrangement for arresting a detonation propagating in a pipeline. The arrangement comprises a means for attenuating the transverse shock waves associated with a propagating detonation, thus causing detonation failure, and a means for arresting any flame which may result when the detonation fails. In one embodiment, the flame arresting means comprises two flame arrestors, one each being positioned on opposite sides of the attenuating means.

In accordance with another embodiment of the present invention, there is provided an arrangement for arresting a detonation propagating in a pipe wherein a section of the pipe contains an absorbent shock wave attenuating section comprising a single acoustically absorbent channel. The channel preferably has an internal diameter equal to or larger than the internal diameter of the pipe and has its longitudinal axis coincident with the center line of the pipe. The attenuating section is interposed between two flame arresting means.

In accordance with yet another embodiment of the present invention, there is provided an arrangement for arresting a detonation propagating in a pipe wherein the arrangement contains an absorbent shock wave attenuating section comprising a plurality of acoustically absorbent channels separated by short straight sections of pipe. This attenuating section is also interposed between two flame arresting means.

In accordance with yet a further embodiment of the present invention, there is provided an arrangement for arresting a detonation propagating in a pipe wherein the arrangement contains an absorbent shock wave attenuating section comprising acoustically absorbent channels. The attenuating section is preferably positioned a distance equal to two interior pipe diameters from the location where the pipe joins the vessel. In this embodiment, the pipe may contain flame arrestors but they are not necessary. This embodiment requires that the pipe be of sufficient strength and be mounted using sufficiently strong supports such that neither the pipe or its environs be damaged by an internal detonation in the pipe. Further, this embodiment requires that the vessels in question are adequately vented for the resulting combustion explosion in the vessel.

In accordance with yet a further embodiment of the present invention, there is provided an arrangement for arresting a detonation propagating in a pipe wherein the arrangement contains an absorbent shock wave attenuating section comprising a plurality of acoustically absorbent channels spatially arranged within the pipe such that the axes of the channels are coincident with the centerline of the pipe. The channels may be of any appropriate cross section, e.g., circular, square, rectangular, hexagonal, plates, etc. This attenuating section is also interposed between two flame arresting means.

DETAILED DESCRIPTION OF PREFERRED EMBODIMENTS

Figure 1:
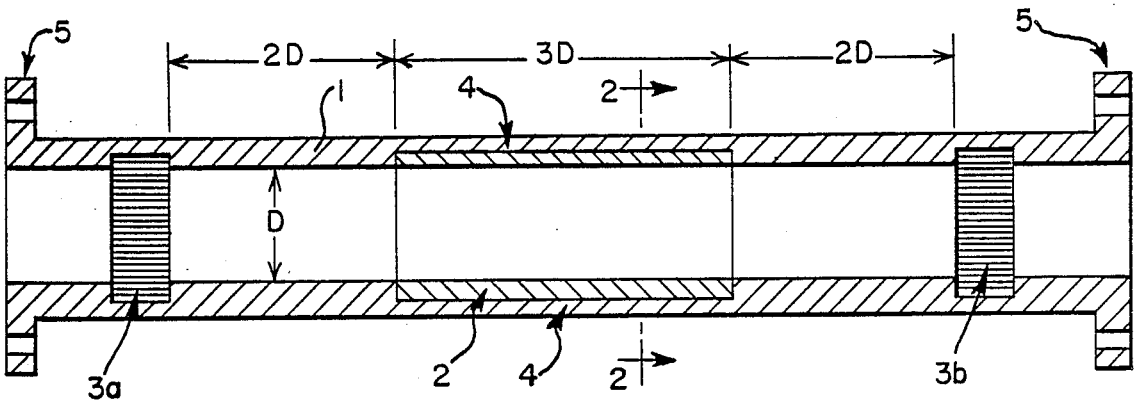
FIG. 1 depicts an absorbent section interposing two flame arrestors.

It has now been discovered that supplying a section of pipe wall with a suitable material of sufficiently low acoustic admittance, transverse waves, which are necessary for detonation propagation, can be damped causing detonation failure. Furthermore, providing a flame arrestor in the pipe means such as conventional flame arrestors, prevents propagation of any flame resulting from detonation failure or its acceleration to detonation.

One advantage of the present invention is that a short section of pipe wall made of an acoustic energy absorbent material will cause only a very small increase in pressure drop, yielding economic savings. A further advantage is that processors who employ the present invention will be able to prevent detonations which may happen to be propagated in either direction in a pipeline.

Flames and detonations propagate by completely different mechanisms and at markedly different propagation rates. Flames propagate at low subsonic velocities, typically less than one meter per second. Flames propagate because heat transfer and diffusion of active species (radicals) trigger the high temperature chemical reactions that lead to complete combustion. The interaction of these basic processes determines the rate of propagation and thickness of flames.

Because flames have a finite thickness, they cannot propagate through small gaps. This basic characteristic is used in the design of in-line flame arrestors for pipelines. In general, flame arrestors comprise two sheets of metal, one flat and one corrugated with corrugations smaller than the quenching distance of the flame. The sheets are rolled together and mounted in a pipe so that the channels that are produced run parallel to the center line of the pipe. With this arrangement, any flame propagating through the pipe in either direction is extinguished by heat loss to the channel walls.

Flame arrestors of the above construction are presently preferred. It is to be understood, however, that any means for arresting a flame is contemplated by the present invention For example, the pipe may be attached to a sufficiently vented vessel which will allow the pressure rise to vent without damaging the local environment.

Detonations propagate at high supersonic velocity, typically 1500 to 2000 meters per second. Heat transfer and radical diffusion play little or no part in their propagation mechanism. Any wave that propagates at high supersonic velocity contains a lead shock wave. The classical Chapman-Jouguet (CJ) theory adequately predicts gross or average detonation properties such as propagation velocity and average frontal pressure. The theories, however, cannot be used to predict detonation limits or failure behavior.

Self-sustaining detonations propagate by a mechanism that requires a finite amplitude transverse instability on the front. It is well known that a detonation in a pipe of a gas phase mixture whose composition is well inside the limit compositions propagates at an average velocity that can be predicted by the CJ theory. It is also well known that such a detonation contains, in its reaction zone behind the lead shock wave, transverse shock waves propagating across the front in either random directions or in directions that couple with the standing acoustic transverse modes of the hot gas column behind the detonation in the pipe.

These transverse waves are believed to have three properties that are important to detonation failure. First, they must be present for detonation propagation. Second, they have a finite amplitude which is controlled primarily by acoustic considerations (decay) and localized continuous explosions that occur at the intersection of the transverse waves in the reaction zone following the lead shock wave (amplification). Finally, the transverse waves have a finite spacing or cell size which is dependent on initial conditions and is related, in a fundamental way, to the rate at which combustion chemistry is occurring in the wave.

Based on both theory and experimental data, it is known that for a specific mode of propagation, the spacing of transverse waves is related to the fluid composition being transported in the pipe and initial conditions, such as pressure Thus, the transverse wave spacing is related to the rate of the exothermic reactions that occur in a detonation, and therefore to detonation failure For example, it has been shown that when the ratio d/D (where d is the transverse wave spacing of the particular fluid being transported at specific initial conditions and D is the internal pipe diameter) has a value of the order of Pi (3.14), transition from a deflagration to a self-sustained detonation is not possible.

The detonation arrestor of the present invention comprises any means for attenuating the transverse shock waves associated with the propagation of a detonation Preferably, since acoustical absorbents will generally attenuate transverse shock waves, the attenuating means will comprise acoustically absorbent material. In one embodiment, an acoustical absorbent may be disposed in section or sections of the wall of a pipe while in another embodiment the absorbent may be disposed in a porous walled tube bundle arrangement which is inserted in the pipe such that the axes of the tubes are parallel to the center of the pipe Acoustically absorbent materials contemplated by the present invention may comprise any porous material, such as sintered bronze, stainless steel, ceramic material, or the like. Alternatively, the acoustical absorbent may comprise a wire mesh screening constructed of sturdy materials such as fiber glass, stainless steel and the like. In addition, combinations of the above materials and absorbents are also contemplated by the present invention.

The present invention may be employed to arrest detonations only in pipe lines carrying dry combustible gases. The term dry gas as used herein means the absence of a substantial liquid phase. When employed in gas carrying pipe lines, the acoustical absorbent is constructed of material which is compatible with the particular gas or gases carried. Further, the coarseness or pore size of the acoustically absorbent material must be less than the quenching distance of a flame that could propagate in the gases expected to be carried in the pipe. Here, the quenching distance is the minimum gap through which a flame can propagate for the conditions in the pipe and is the same distance as that used to design the corrugated flame arrestor described above. If the material were coarser, it could possibly have the adverse effect of causing flame acceleration.

Figure 2:
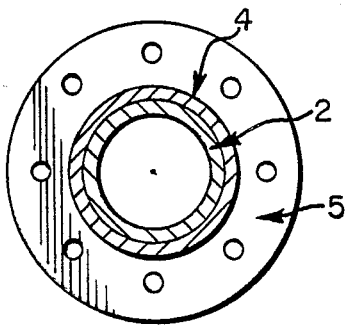
FIG. 2 depicts a cross section of the absorbent section of FIG. 1.

In accordance with one embodiment of the present invention, with reference to FIGS. 1 and 2, the detonation arrestor arrangement preferably comprises a single cylindrically shaped pipe section 1 containing a sound absorbent interior section 2 constructed of suitable acoustical absorbent material. Section 2 has an inside diameter D or larger and a length 3D, where D is the inside diameter of the pipe. The arrestor arrangement further contains flame arrestors 3*a* and 3*b*, placed a distance 2D from either side of the absorbent section.

Absorbent section 2 and flame arrestors 3*a*, 3*b* fit into inner walls 4 of pipe section 1 or may be embedded therein as shown The ends of pipe section 1 may also contain flanges 5, flares or the like.

A detonation propagating in the above arrangement will be arrested regardless of the direction from which it propagates, and any flame which may be present after detonation failure is extinguished by the flame arrestors. Thus there is no further flame which could accelerate to detonation.

Figure 3:
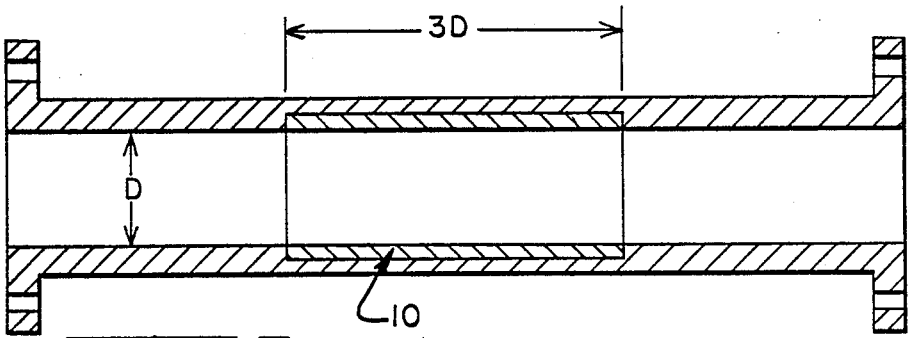
FIG. 3 depicts an absorbent section in a pipe.
Figure 4:
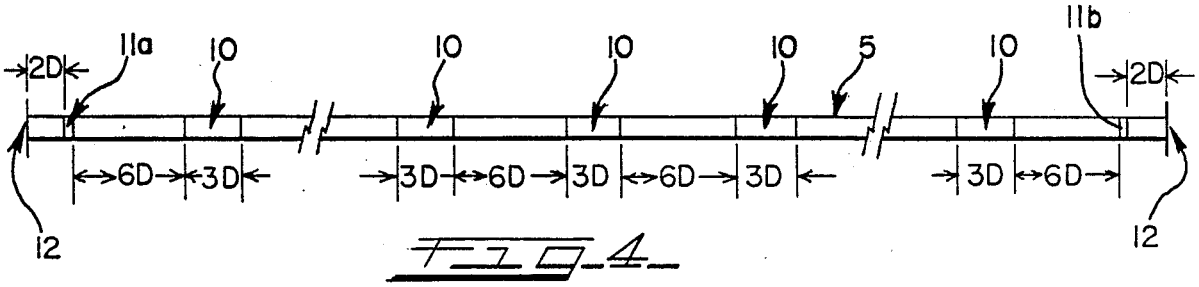
FIG. 4 depicts a plurality of absorbent cylinders in a pipe.

In accordance with another embodiment of the present invention, with reference to FIGS. 3 and 4, the detonation arrestor arrangement comprises a plurality of evenly spaced and cylindrically shaped acoustical absorbent sections 10 of the type illustrated in FIGS. 1 and 2, with flame arrestor means, 11*a* and 11*b*, positioned within 2D of the ends of pipe section 12 on both sides of a plurality of sections 10. As above, after a detonation has been arrested, regardless of the direction from which it propagated, the resulting flame is also extinguished by flame arrestors 11*a* and 11*b*.

Preferably, the spacing between the plurality of absorbent sections 11 is larger than 6D and their length is 3D.

Figure 5:
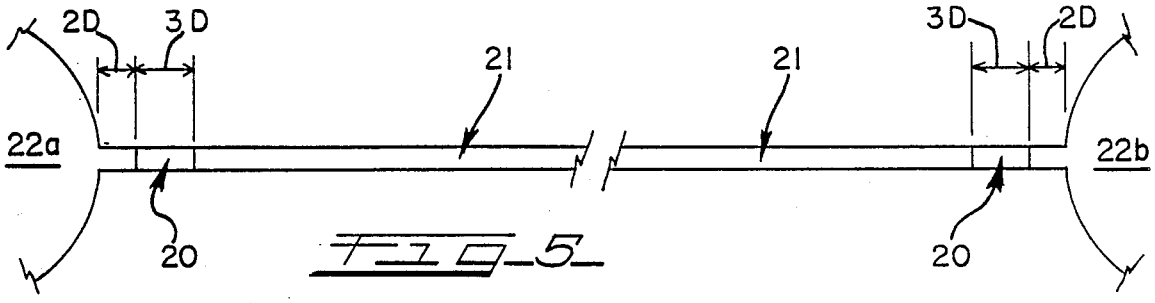
FIG. 5 depicts an absorbent section interposing two vessels.
Figure 6:
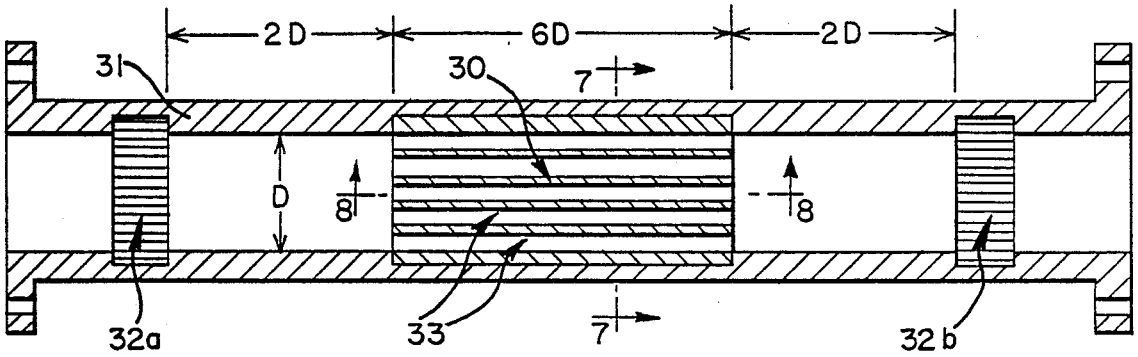
FIG. 6 depicts an absorbent section comprising a plurality of channels interposing two flame arrestors.
Figure 7:
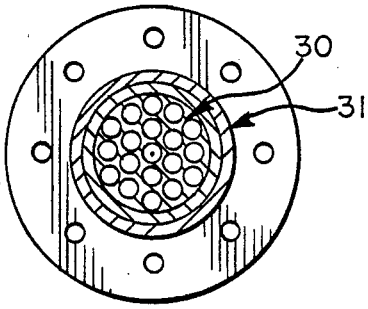
FIG. 7 depicts a cross section of the absorbent section of FIG. 6.
Figure 8:
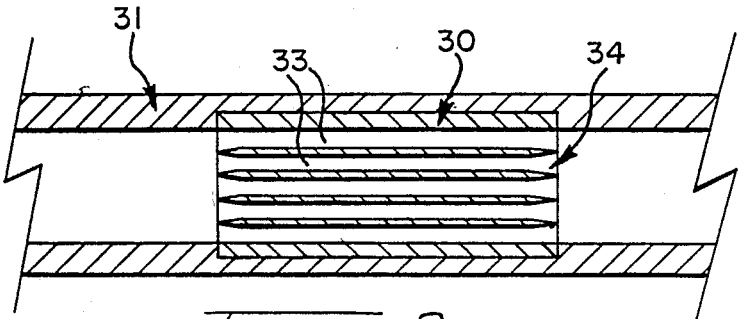
FIG. 8 depicts an absorbent section comprising a plurality of channels with tapered ends.

In accordance with another embodiment of the present invention, with reference to FIG. 5, a detonation arrestor arrangement of the present invention comprises two absorbent sections 20 positioned within 2D of the location where pipe 21 ends and enter a process or storage vessel 22*a* and 22*b*. In this embodiment the pipe run must be sufficiently strong to withstand damage and be constructed so as to not cause damage to its environs by the occurrence of an internal detonation under upset conditions. Also in this embodiment, the vessels must contain vent means sufficient to vent any combustion explosion in the vessel which may result when any flame from the arrested detonation enters the vessel. Thus, this embodiment could not be employed when the pipe is connected to either the discharge or suction end of a pump or blower In accordance with yet another embodiment of the present invention, with reference to FIGS. 6, 7 and 8 the detonation arrestor arrangement of the present invention comprises a porous absorbent section 30 inserted in pipe 31 with flame arrestor means 32*a* and 33*b*, positioned on either side of the section. The arrangement of this embodiment is presently preferred for large diameter pipes.

In this embodiment porous section 30 comprises a plurality of acoustically absorbent channels 33 constructed from the acoustically absorbent materials mentioned herein. Preferably, the channels are positioned such that their longitudinal axes are substantially parallel to the center line of pipe 31. Further, means for reducing the pressure drop in the pipe, such as by tapering ends 34 of channels 33 are also contemplated.

Preferably, the channels are constructed to form cylindrical tubes extending the length of the absorbent section and have a length of 6D or 13*d* (which ever is less) and an inside diameter (ID) equal to d/3 (where d is the transverse wave spacing of the particular gas being transported at specific initial conditions). While a generally spherical shape is preferred, channels 33 may have other appropriate cross sectional shapes, e.g., square, rectangular, hexagonal, plates, etc. Flame arrestors 32*a* and 32*b* are positioned on either side of the channel bundle a distance of about two times the inside diameter (2D) of the pipe. As above, this allows a detonation to be arrested regardless of the direction that it propagates.

It is to be understood that the embodiments discussed above are not to be considered a limitation of the present invention, the full scope of which is delineated in the appended claims. Those skilled in the art will readily recognize that equivalents of the particular embodiments and elements of the present invention discussed herein are also contemplated.

We claim:

1. A detonation arrestor comprising:

(a) a transverse shock wave absorbing means;

(b) a first flame arresting means positioned at one end of the absorbing means; and (c) a second flame arresting means positioned at the other end of the absorbing means and aligned with the absorbing means and first flame arresting means.

2. The detonation arrestor of claim 1 wherein the absorbing means comprises an acoustically absorbent material.

3. The detonation arrestor of claim 1 wherein the absorbing means comprises sintered bronze, stainless steel, or ceramic material.

4. The detonation arrestor of claim 1 wherein the absorbing means comprises wire mesh.

5. The detonation arrestor of claim 1 wherein the absorbing means comprises an absorbent cylinder having a length about three times its diameter, and the first and second flame arrestors are positioned a distance of about two times the diameter of the cylinder.

6. The detonation arrestor of claim 1 wherein the absorbing means comprises a plurality of axially aligned absorbent cylinders, each cylinder having substantially the same diameter and being spatially arranged at intervals of about six times that diameter.

7. The detonation arrestor of claim 6 wherein the first and second flame arrestors are positioned a distance of about two times the diameter of the cylinders.

8. The detonation arrestor of claim 1 wherein the absorbing means comprises a cylinder shaped member containing a plurality of channels, each channel having its center line substantially parallel to the center line of the cylinder shaped member.

9. The detonation arrestor of claim 1 wherein at least one of the flame arrestors comprise a vessel wherein the vessel contains means for venting a combustion explosion.

10. A detonation arrestor comprising:

(a) a transverse shock wave absorbing means comprising a cylinder shaped member containing a plurality of cylinder shaped channels, each channel having its center line substantially parallel to the center line of the cylinder shaped member;

(b) a first flame arresting means positioned at one end of the cylinder shaped member and on the member center line; and (c) a second flame arresting means positioned at the other end of the cylinder shaped member and on the member center line.

11. The detonation arrestor of claim 10 wherein the channels have a length of about two times the diameter of the cylinder shaped member.

12. The detonation arrestor of claim 10 wherein the ends of the channels are tapered.

13. A detonation arrestor comprising:

(a) a transverse shock wave absorbing means comprising a plurality of aligned acoustically absorbent sections;

(b) a first flame arresting means positioned at one end of the plurality of absorbent sections; and (c) a second flame arresting means positioned at the other end of the plurality of absorbent sections and aligned with the plurality of absorbent sections and the first flame arresting means.

14. The detonation arrestor of claim 13 wherein the absorbent sections comprise absorbent cylinders, each cylinder having substantially the same diameter and being spatially arranged at intervals of about six times that diameter.

15. The detonation arrestor of claim 13 wherein at least one absorbent section comprises a cylinder shaped member containing a plurality of channels, each channel having its center line substantially parallel to the center line of the cylinder shaped member.

16. A detonation arrestor comprising:

(a) a cylinder shaped member;

(b) a transverse shock wave absorbing means disposed within the cylinder shaped member;

(c) a first flame arresting means disposed within the cylinder shaped member and positioned on one side of the absorbing means; and (d) a second flame arresting means disposed within the cylinder shaped member and positioned on the other side of the absorbing means.

17. The detonation arrestor of claim 16 wherein the absorbing means comprises an absorbent cylinder having its center line substantially coincident to the center line of the cylinder shaped member, the absorbent cylinder having an internal diameter about equal to the internal diameter of the cylinder shaped member and a length of about three times the internal diameter of the cylinder shaped member.

18. The detonation arrestor of claim 16 wherein the first and second flame arrestors are each positioned from the absorbent cylinder a distance of about two times the internal diameter of the cylinder shaped member.

19. The detonation arrestor of claim 16 wherein the absorbing means comprises a plurality of aligned acoustically absorbent cylinders, the center lines of the absorbent cylinders being substantially coincident to the center line of the cylinder shaped member, each of the absorbent cylinders having an internal diameter about equal to the internal diameter of the cylinder shaped member and a length of about three times the internal diameter of the cylinder shaped member, the plurality of absorbent cylinders being spatially arranged at intervals of about six times the internal diameter of the cylinder shaped member.

20. The detonation arrestor of claim 19 wherein the first and second flame arresting means are each positioned from the absorbent means a distance of about two times the internal diameter of the cylinder shaped member.

21. The detonation arrestor of claim 16 wherein the cylinder shaped member is adaptable to be fitted into a pipe.

22. The detonation arrestor of claim 16 wherein the cylinder shaped member is a pipe.

23. A detonation arrestor comprising:

(a) a transverse shock wave absorbing means;

(b) a first vessel wherein the vessel contains means for venting a combustion explosion and is positioned at one end of the absorbing means; and (c) a second vessel wherein the vessel contains means for venting a combustion explosion and is positioned at the other end of the absorbing means.

* * * * *

UNITED STATES PATENT AND TRADEMARK OFFICE

CERTIFICATE OF CORRECTION

PATENT NO. : 4,975,098

DATED : December 4, 1990

INVENTOR(S) : John H.S. Lee et al.

It is certified that error appears in the above-identified patent and that said Letters Patent is hereby corrected as shown below:

In column 3, line 47, after "invention" please insert --.--.

In column 4, line 21, after "pressure" please insert --.--.

In column 4, lines 23 and 24, after "failure" please insert --.--.

In column 4, line 32, after "detonation" please insert --.--.

In column 4, line 41, after "pipe" please insert --.--.

In column 5, line 11, after "shown" please insert --.--.

In column 5, line 53, please delete "33b" and substitute therefor --32b--.

Signed and Sealed this

Twenty-second Day of September, 1992

*Attest:*

DOUGLAS B. COMER

*Attesting Officer*

*Acting Commissioner of Patents and Trademarks*